United States Patent [19]

De Vaughn et al.

[11] Patent Number: 4,487,081

[45] Date of Patent: Dec. 11, 1984

[54] PIPETTING TECHNIQUES USING REPLACEABLE TIPS

[75] Inventors: Donald H. De Vaughn, 119 Skyview Way, San Francisco, Calif. 94131; Philip S. Watts, Pingree, Id.; Dallas L. Raty, Provo, Utah; Edward H. Maker, II, 3117 Bowling Green Dr., Walnut Creek, Calif. 94598

[73] Assignees: Donald H. De Vaughn; Edward H. Maker, III, both of San Francisco, Calif.

[21] Appl. No.: 412,384

[22] Filed: Aug. 27, 1982

[51] Int. Cl.[3] ..... B01L 3/02

[52] U.S. Cl. ..... 73/864.13; 73/864.16

[58] Field of Search ..... 73/864.13, 864.16, 864.17, 73/864.18; 422/100

[56] References Cited

U.S. PATENT DOCUMENTS

| | | | |
|---|---|---|---|
| Re. 27,637 | 5/1973 | Roach | 73/864.18 |
| 197,017 | 11/1877 | Colmer | 73/864.16 |
| 1,736,392 | 11/1929 | Coss et al. . | |
| 3,045,674 | 7/1962 | Goldberg . | |
| 3,206,072 | 9/1965 | Menken . | |
| 3,253,592 | 5/1966 | Von Pechmann . | |
| 3,297,558 | 1/1967 | Hillquist . | |
| 3,484,207 | 12/1969 | Anthon . | |
| 3,572,998 | 3/1971 | Anthon . | |
| 3,713,774 | 1/1973 | Southwick . | |
| 3,719,087 | 3/1973 | Thiers . | |
| 3,791,560 | 2/1974 | Harris, Sr. . | |
| 3,882,729 | 5/1975 | Roach . | |
| 3,915,651 | 10/1975 | Nishi | 73/864.16 |
| 3,951,146 | 4/1976 | ChiquiarArias . | |
| 3,982,438 | 9/1976 | Byrd . | |
| 3,991,617 | 11/1976 | d'Autry . | |
| 4,023,716 | 5/1977 | Shapiro . | |
| 4,058,370 | 11/1977 | Souvaniemi . | |
| 4,151,750 | 5/1979 | Souvaniemi et al. . | |
| 4,180,069 | 12/1979 | Walters . | |
| 4,298,575 | 11/1981 | Berglund | 73/864.13 |
| 4,346,742 | 8/1982 | Chase | 73/864.16 |
| 4,418,580 | 12/1983 | Satchell | 73/864.13 |

*Primary Examiner*—S. Clement Swisher

*Attorney, Agent, or Firm*—Flehr, Hohbach, Test, Albritton & Herbert

[57] ABSTRACT

Both manual and automated pipetting apparatus for collecting and dispensing controlled amounts of a given specimen are disclosed herein along with their methods of operation. Each of these apparatus utilizes a pipetting device including a stem which carries a replaceable tip and each device is designed so that a tip, once used, can be automatically removed from its associated stem. Each apparatus disclosed also includes a particular arrangement for placing a new tip on a given stem and each utilizes a specific arrangement for collecting used tips and for cleaning certain components of its pipetting device of specimen residue.

56 Claims, 29 Drawing Figures

STORAGE

IMPALE

CAPTURE

Discharge

Eject

FIGURE 15
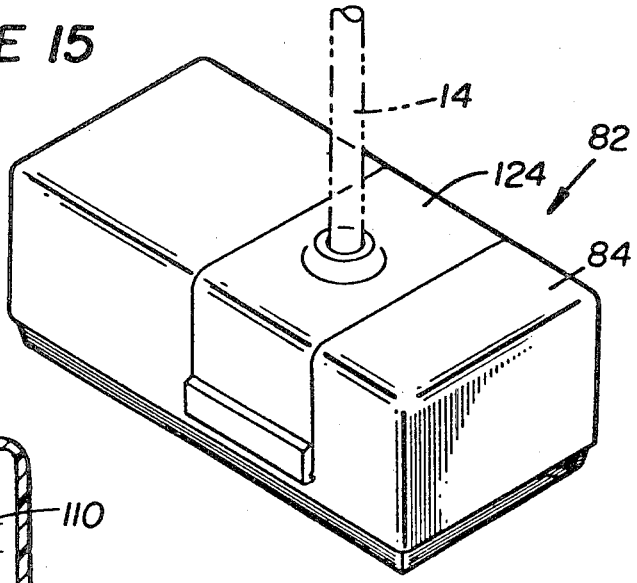
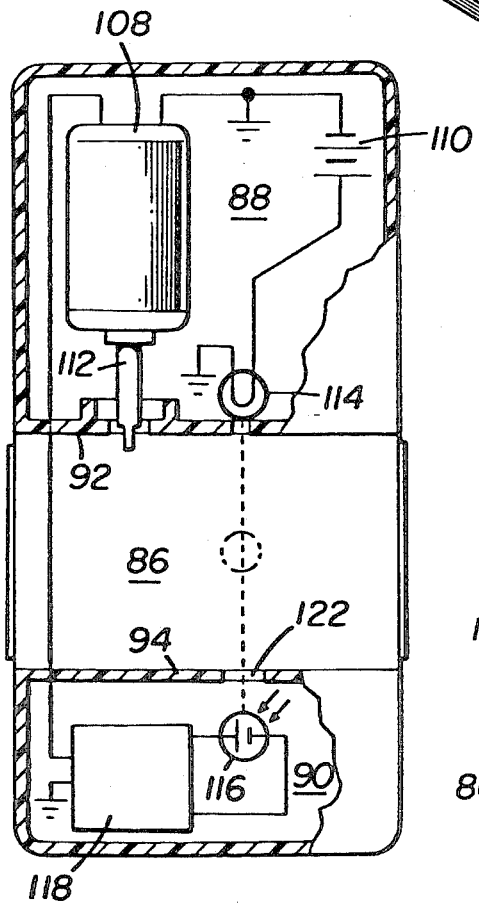
FIGURE 18
FIGURE 16
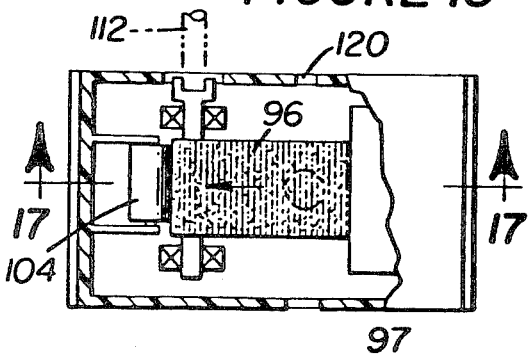
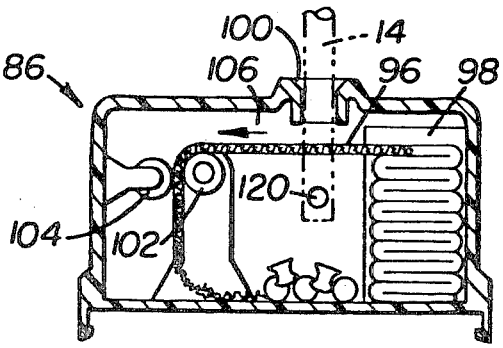
FIGURE 17

FIGURE 19
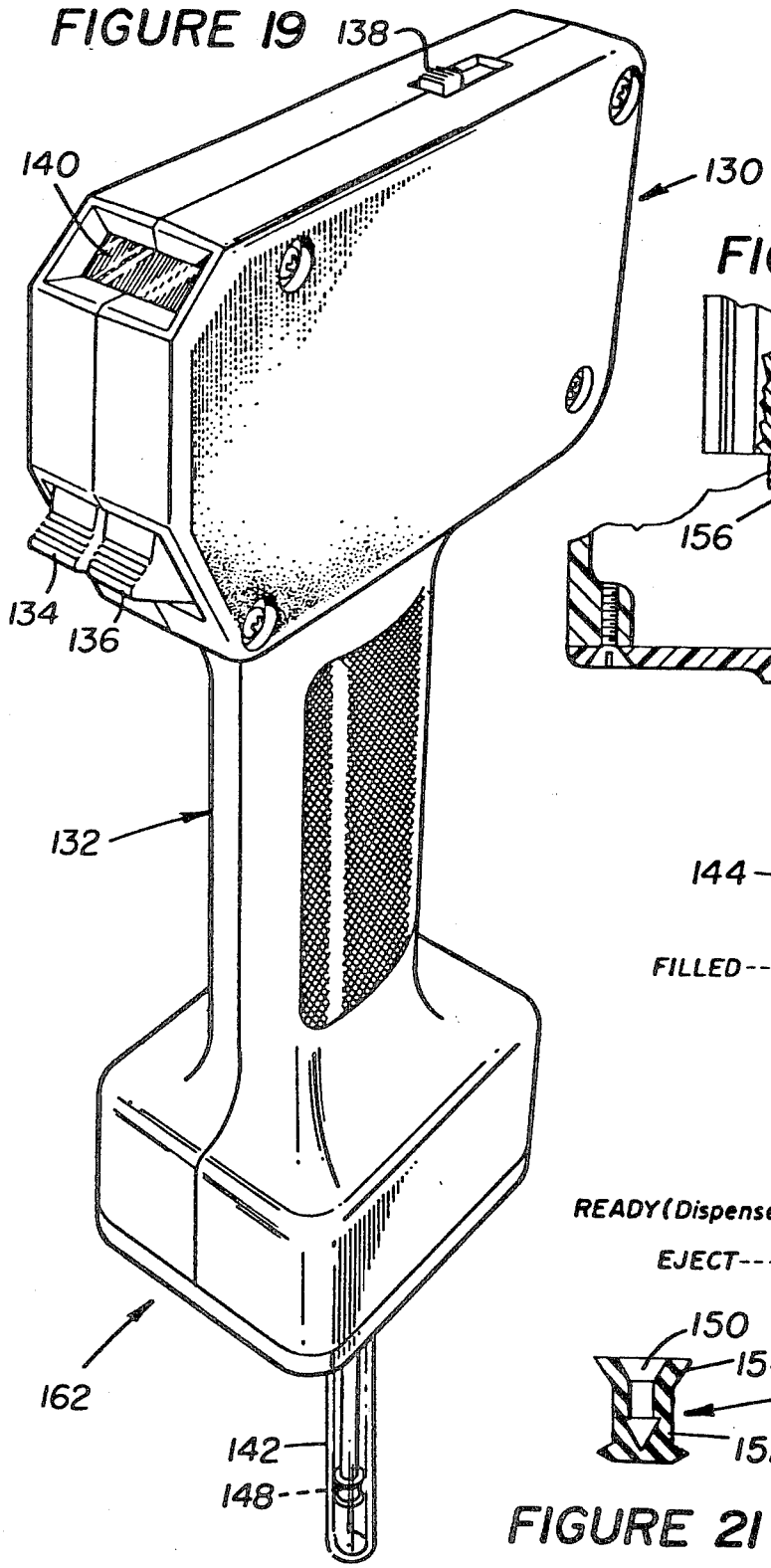
FIGURE 20
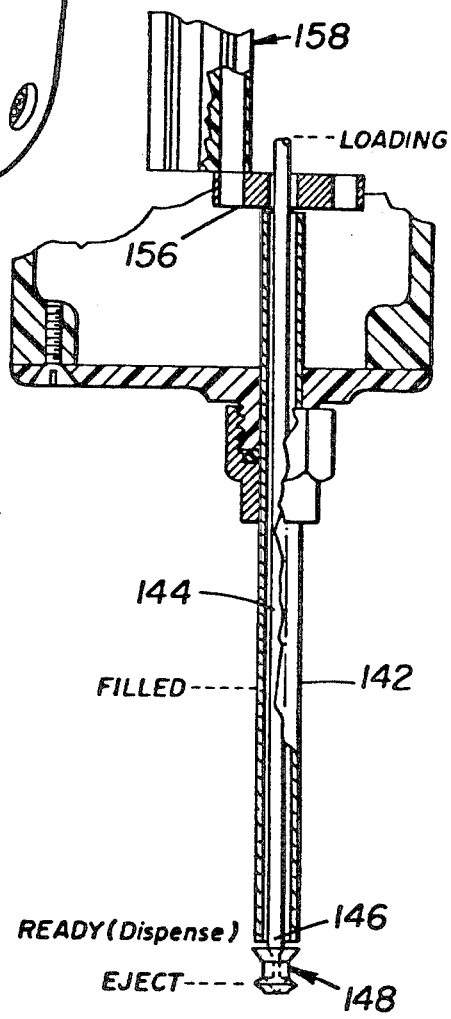
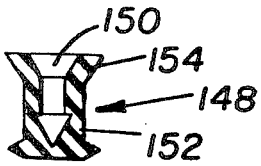
FIGURE 21

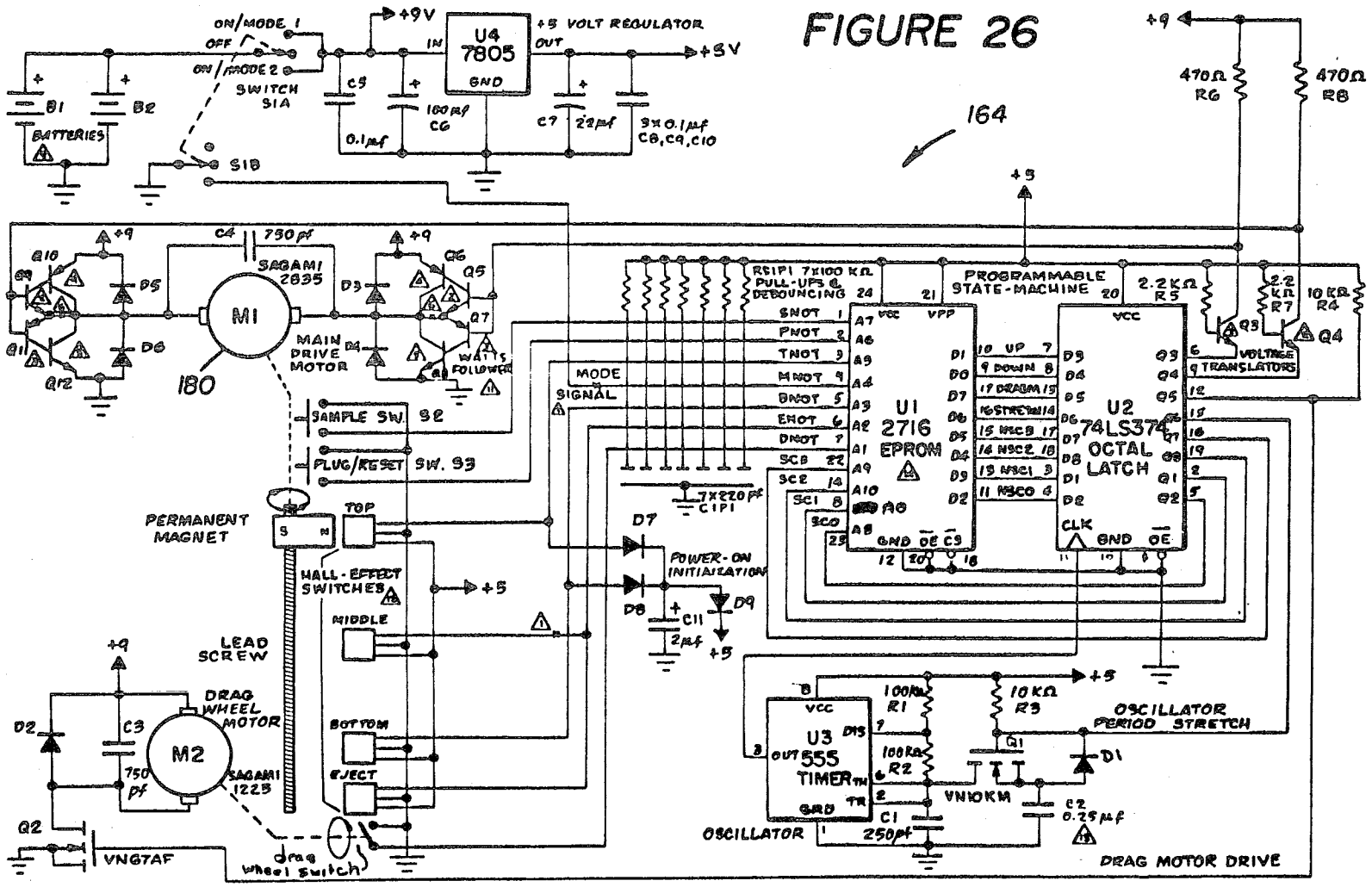
FIGURE 26
164
180
U1 2716 EPROM
U2 74LS374 OCTAL LATCH
PROGRAMMABLE STATE-MACHINE
U3 555 TIMER
U4 7805
+5 VOLT REGULATOR
OSCILLATOR
OSCILLATOR PERIOD STRETCH
DRAG MOTOR DRIVE
MAIN DRIVE MOTOR
M1
M2
DRAG WHEEL MOTOR
LEAD SCREW
PERMANENT MAGNET
HALL-EFFECT SWITCHES
TOP
MIDDLE
BOTTOM
EJECT
SAMPLE SW.
PLUG/RESET
SIGNAL
MODE
POWER-ON INITIALIZATION
BATTERIES
SWITCH S1A
ON/MODE 1
ON/MODE 2
OFF
VOLTAGE TRANSLATORS
DEBOUNCING
PULL-UPS
VNOKM
VNG7AF
drag wheel switch

PIPETTING TECHNIQUES USING REPLACEABLE TIPS

The present invention relates generally to pipetting apparatus and more particularly to specific manual and automated pipetting techniques utilizing replaceable tips and certain support equipment.

There are two basic approaches to pipetting equipment, the "air displacement" approach and the "positive displacement" or "solid" approach. In the first case, a plunger disposed within a cooperating barrel is used to draw a predetermined amount of a given specimen into and dispense it from the barrel while maintaining a layer of air between the plunger and specimen. Although this technique is relatively sanitary in that the plunger itself does not come into contact with the specimen, it is not as accurate as the positive displacement approach which places the plunger in direct contact with the specimen. While this results in a more accurate pipetting procedure, it is less sanitary and may cross contaminate the specimens.

In view of the foregoing, it is an object of the present invention to provide an accurating pipetting technique, preferably of the positive displacement type, and specifically one which is as sanitary as the air displacement approach discussed above.

Another object of the present invention is to achieve the last-mentioned object by providing a pipetting technique which is designed to utilize a replaceable pipette tip each time a specimen is collected in a given barrel and thereafter dispensed therefrom.

A further object of the present invention is to wipe away any residue of a given sample from both the outside and the inside of the barrel after all of the collected sample has been dispensed, thereby further avoiding cross-contamination.

A more particular object of the present invention is to provide a rapid and reliable way of automatically removing a used tip from an associated stem forming part of the pipetting apparatus and rapid and reliable ways of placing a new tip onto the stem.

Another particular object of the present invention is to provide a specific pipette tip which is designed to be readily removed from or readily impaled by an associated pipetting stem in a rapid, reliable and economical fashion.

Still another feature of the present invention is that after a sample has been dispensed from the barrel of the pipettor, the tip as it is being ejected from the barrel wipes the inside surface of the barrel clean. Thus, any sample residue is removed from the inside surface of the barrel and cross-contamination is further avoided.

A further object of the present invention is to provide an uncomplicated and economical arrangement for collecting used pipette tips which are separated from an associated stem forming part of the pipetting apparatus along with the previously mentioned barrel while providing means for automatically wiping any residue of a given specimen from an outer surface section of the barrel.

Still a further object of the present invention is to provide an uncomplicated, reliable and yet economical technique for automating the pipetting procedure which utilizes replaceable tips and which is compatable with the last mentioned tip collecting and residue wiping arrangement.

As will be discussed in more detail hereinafter, the pipetting apparatus disclosed herein utilizes a pipetting device including an elongated barrel and plunger assembly. The barrel has forward and rearward open ends and an inner chamber extending therebetween. The plunger assembly includes a plunger stem which carries a tip on its front end section for movement along the barrel chamber and means for moving the tip within the barrel in a controlled manner for collecting and dispensing a controlled amount of a given specimen. In accordance with the present invention the tip is connected to the front end section of the stem so as to be readily removable therefrom and connectable thereto without damage to the stem, whereby a given tip can be readily replaced with another tip. In one embodiment of the present invention, manual means are provided for moving the stem and connected tip and in another embodiment automated means are provided.

In both the manual and automated embodiments of the pipetting device disclosed herein, the plunger stem is preferably sufficiently long relative to its associated barrel chamber so as to make the tip and the front end section of the stem movable into a "tip eject" position outside and in front of the forward end of the barrel. At the same time, the tip is specifically designed relative to the barrel and its associated stem for automatic removal from the latter while in this position. This is accomplished in accordance with the present invention by making at least a portion of the tip movable between a forced or squeezed contracted configuration sufficiently small to fit within the barrel chamber and a biased or relaxed, expanded position sufficiently large so as not to fit within the barrel. Once a used tip is removed from its associated stem, an arrangement is provided in accordance with the present invention for placing a new tip onto the stem outside the barrel chamber in a way which maintains the tip in its contracted configuration until it is located within the barrel chamber.

As stated previously, in one embodiment of the present invention, the pipetting device thus far described is operated manually. In another embodiment, the overall apparatus includes means for operating the pipetting device in a power driven, automated fashion. In this latter embodiment, a specimen is collected within a given barrel chamber and dispensed therefrom and the used tip is replaced with a new tip in a power driven, automated procedure. In either of these embodiments, the present invention also provides a collection chamber for used tips and an arrangement including an automatically replaceable cloth which wipes any specimen residue from the outer surface of the front end section of the barrel each time a tip is removed.

The foregoing features and other features of the overall pipetting apparatus disclosed herein will be discussed in more detail hereinafter in conjunction with the drawings wherein.

Figure 1:
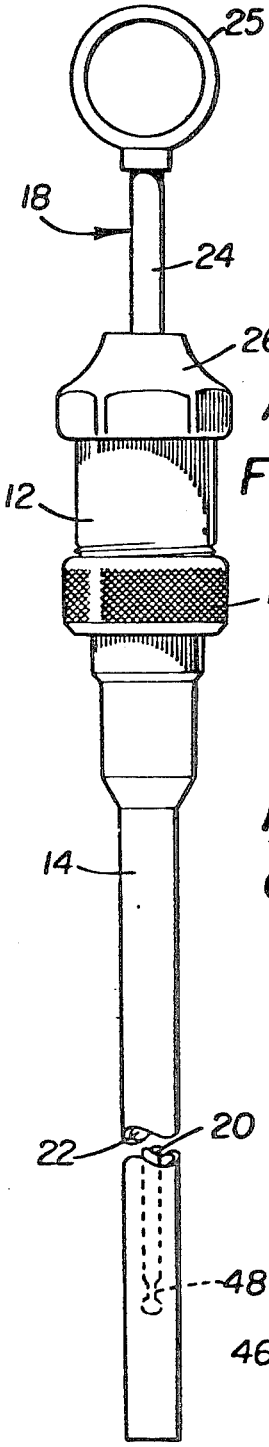
FIG. 1 is a side elevational view of a manually operated pipetting device designed in accordance with the present invention to include a readily displaceable pipette tip.
Figure 2:
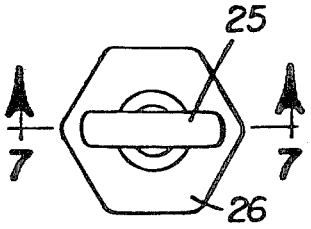
FIG. 2 is a top plan view of the device of FIG. 1.
Figure 3:
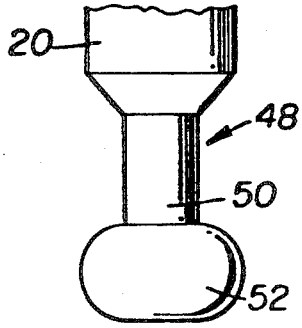
FIG. 3 is an enlarged side elevational view of a front end portion of a stem forming part of the pipetting device illustrated in FIG. 1.
Figure 22:
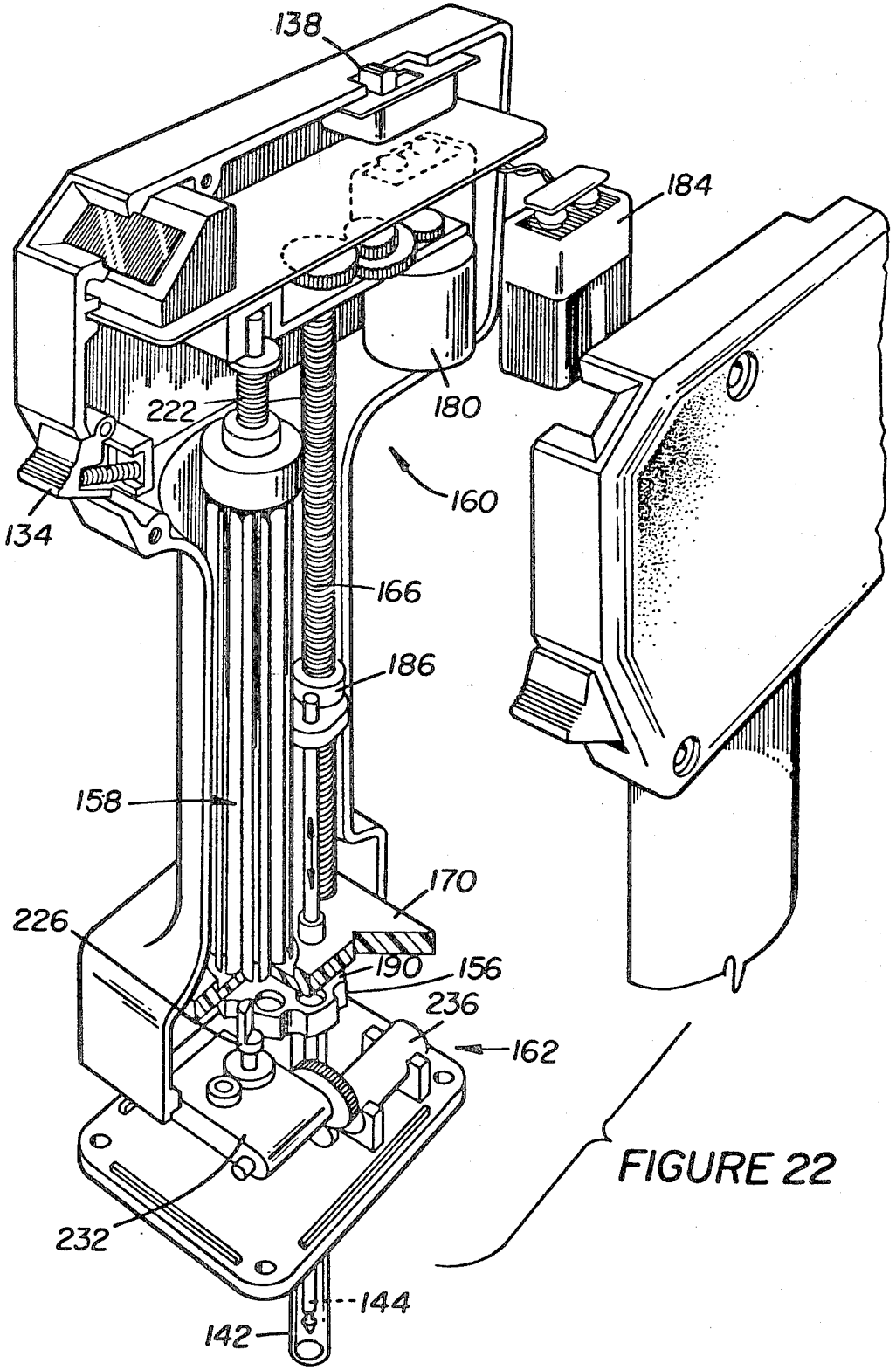
Figures 23, 24:
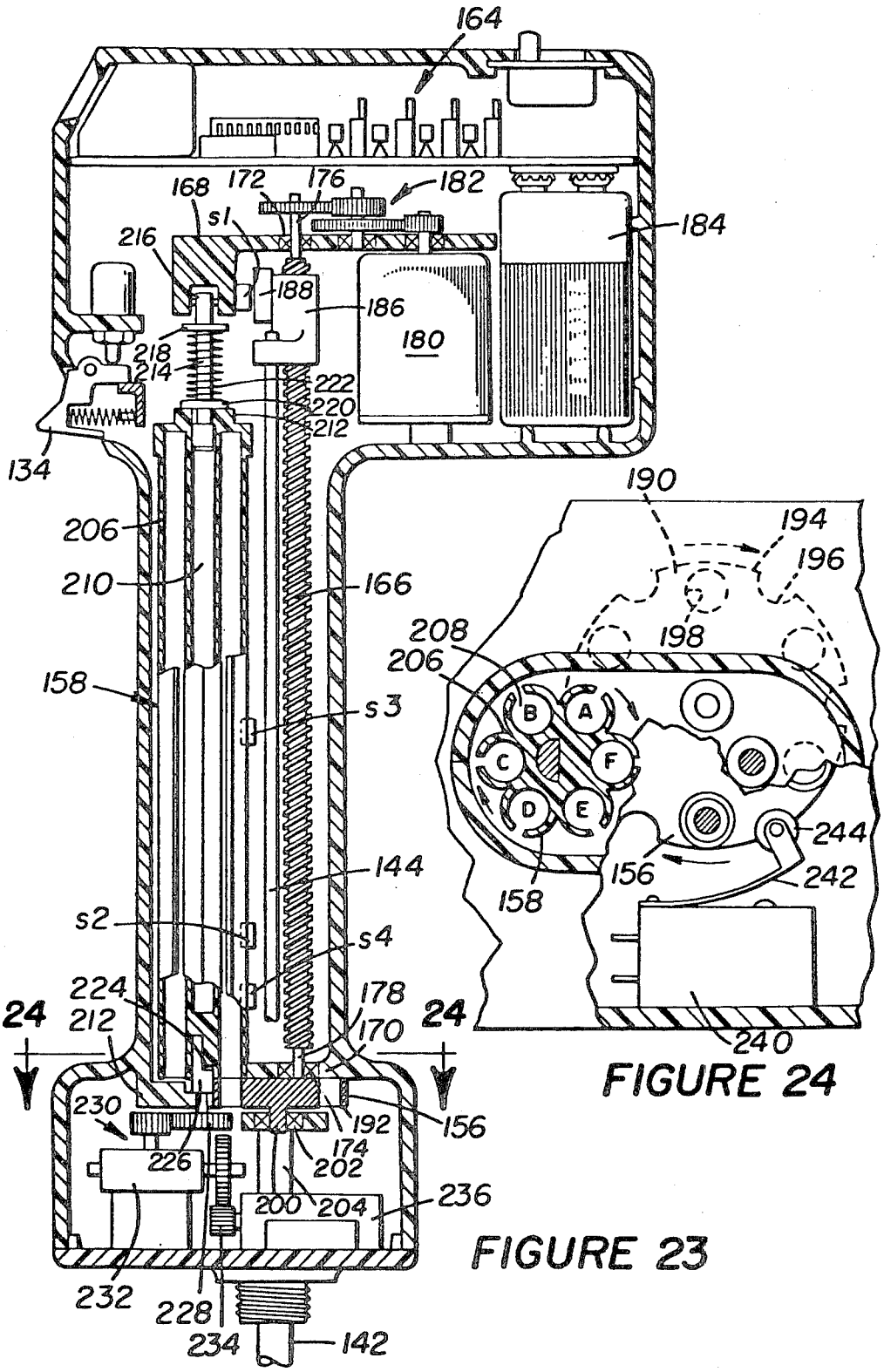
Figure 25:
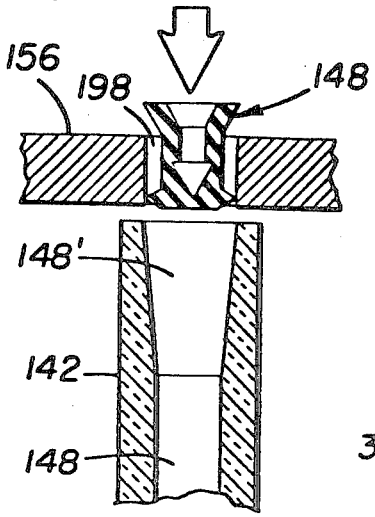
Figure 27:
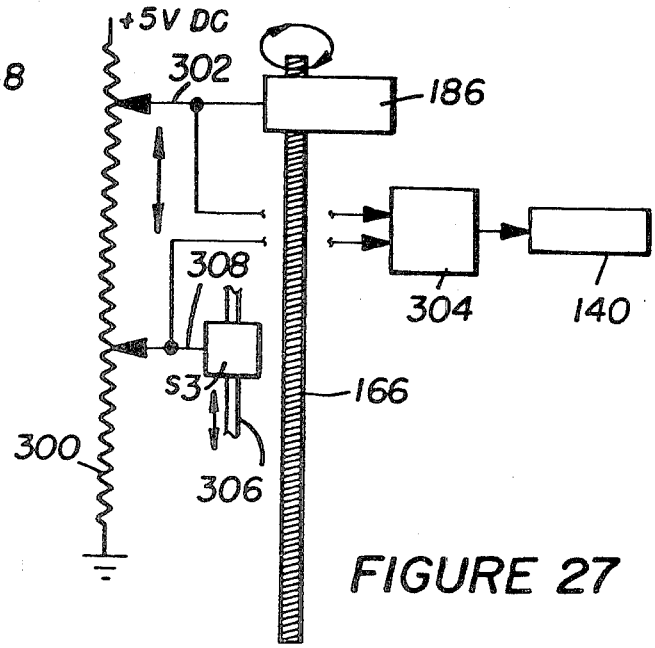
Figure 25:
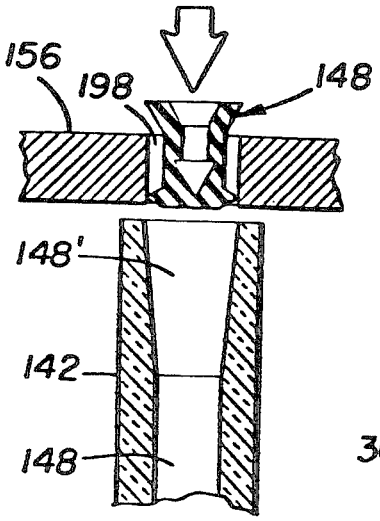
Figure 27:
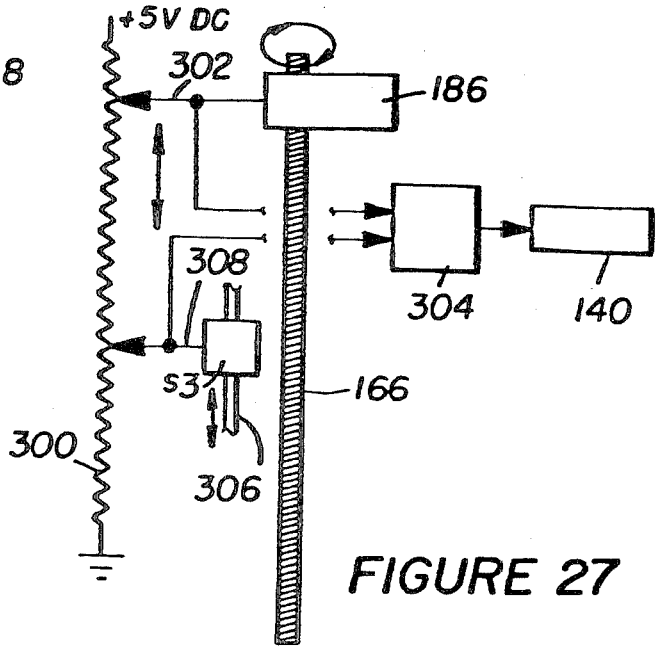

FIGS. 10–12, 13*a*, 13B, 14*a*, and 14B diagrammatically illustrate how the pipetting device of FIG. 1 is used to collect a given specimen within its barrel and thereafter dispense the collected specimen and how the pipette tip used in this process is thereafter automatically removed from the stem;

FIG. 15 is a perspective view illustrating an arrangement designed in accordance with the present invention for collecting used pipette tips and, at the same time, wiping an outer surface of the pipette barrel of specimen residue;

FIG. 16 is a partially broken away top plan view of a section of the arrangement of FIG. 15, specifically a section illustrating its cleaning chamber;

FIG. 17 is a side elevational view in section of the cleaning chamber illustrated in FIG. 16, taken generally along line 17—17 in FIG. 16;

FIG. 18 is a partially broken away top plan view of the overall arrangement illustrated in FIG. 15, specifically illustrating a drive system forming part of the overall arrangement;

FIG. 19 is a perspective view of an automated, power driven pipetting device designed in accordance with a number of features of the present invention including the utilization of replaceable pipette tips;

FIG. 20 is a partially broken away side elevational view of a bottom section of the device illustrated in FIG. 19 and specifically illustrating its stem in a tip eject position;

FIG. 21 is an enlarged longitudinal sectional view of a pipette tip for use with the device illustrated in FIG. 19;

FIG. 22 is an exploded perspective view of the automated, power driven pipetting device illustrated in FIG. 19;

FIG. 23 is a longitudinal sectional view of the device illustrated in FIG. 19;

FIG. 24 is a sectional view of a portion of the device of FIG. 19, taken generally along line 24—24 in FIG. 23;

FIG. 25 is a side elevational view of another portion of the device of FIG. 19, particularly a view illustrating how a replaceable tip is impaled onto the associated stem and placed into its associated barrel;

FIG. 26 is a schematic illustration of circuit components forming part of the pipetting device illustrated in FIG. 19 for operating the device in an automated, power driven fashion; and, FIG. 27 schematically illustrates additional circuitry forming a modification to the automated pipetting device shown in FIGS. 19–25.

Figure 7:
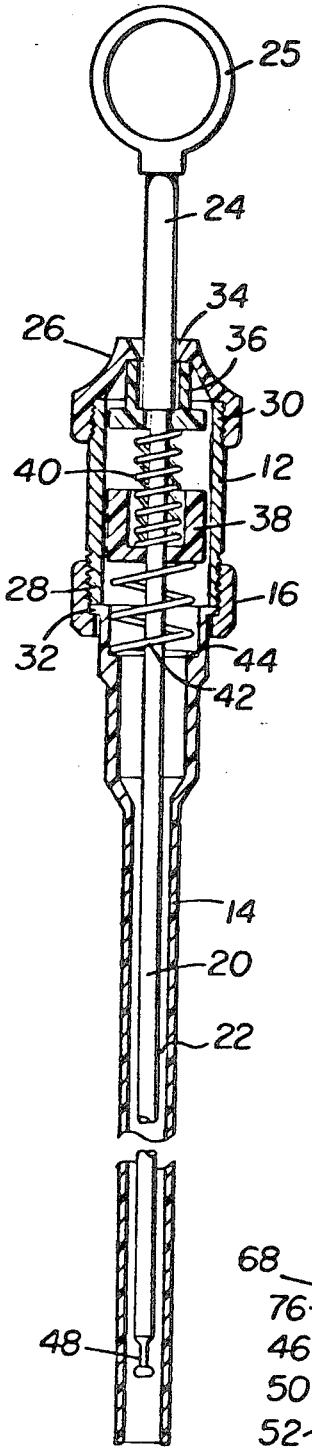
FIG. 7 is a partial longitudinal sectional view of the pipetting device illustrated in FIG. 1 and specifically shown in a stored condition without a pipette tip.

Turning now to the drawings wherein like components are designated by like reference numerals throughout the various figures, attention is first directed to FIGS. 1–4 which together illustrate a manually operated pipetting device designed in accordance with the present invention. This device is generally designated by the reference numeral 10 in FIG. 1 and includes a hollow main body 12 and an elongated open ended barrel 14 which are connected together at adjacent ends by means of a coupling 16. The device also includes a stem 18 having a front section 20 which extends co-axially through main body 12 and a chamber 22 defined by barrel 14, as best illustrated in FIG. 7. The stem also includes a cross-sectionally larger back section 24 which carries a fingerhold 25 and which extends partially into main body 12 through an end cap 26. The end cap is connected around the back end of the main body which serves as a support guide for section 24. The main body 12 for any given device 10 will have a given length corresponding to the desired stroke length of stem 18 for determining the desired amount of sample to be taken.

Referring to FIG. 7, it can be seen that main body 12 takes the form of a cylindrical sleeve which is externally threaded at its forward and rearward ends for thread connection with coupling 16 and end cap 26 respectively. At the same time, coupling 16 engages behind an annular flange 32 forming the back end of barrel 14 for connecting the barrel to the main body and end cap 26 includes a central opening 34 for receiving stem section 24. The overall stem is supported for axial movement relative to main body 12 and barrel 14 by a number of components located within the main body. These components include an upper inner sleeve 36 disposed around stem 18 at the juncture between stem sections 20 and 24 and a lower inner sleeve 38 disposed around stem section 22 a predetermined distance from member 36. Upper sleeve 36 serves to limit the upward movement of the stem by engaging the underside of cap 26 and lower sleeve 38 serves to limit the downward movement of the stem by engaging shoulder 32 of barrel 14. In addition, an upper spring 40 is disposed around the segment of end section 22 between members 36 and 38 and a larger spring 42 is disposed between member 38 and an inner annular shoulder 44 inside barrel 14 inwardly of and below flange 32. These two springs and the two sleeves 36 and 38 serve to spring bias the stem in its stored position shown in FIG. 7 and, at the same time, allow the stem to be manually moved to other positions to be discussed hereinafter. Spring 40 is more easily compressed than spring 42 thus enabling the operator to tactilly position the tip of the Ready/Discharge position as described below.

Figure 4:
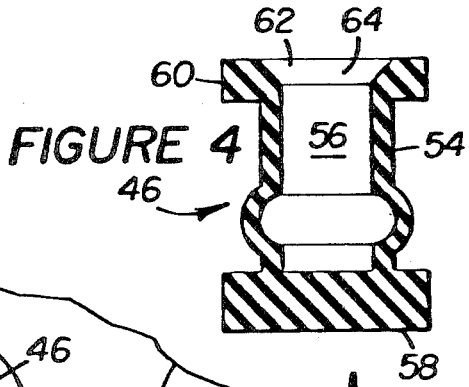
FIG. 4 is an axial sectional view of a replaceable tip forming part of the pipetting device illustrated in FIG. 1 and designed to be readily removed from and connected with the front end section of the stem illustrated in FIG. 3 without damaging the latter.

In addition to the components thus far described, the overall pipetting device 10 includes a pipette tip which is shown in FIG. 4 at 46 and which, in accordance with the present invention, is designed to be readily and rapidly mountable to and removable from a forwardmost end segment 48 of stem 18 without damage to the stem. To this end, segment 48 of the stem which is shown best in FIG. 3 includes a constricted portion 50 of stem section 20 and endmost enlarged bulb 52 at the otherwise free end of portion 50.

As illustrated in FIG. 4, pipette tip 46 includes a hollow main body 54 having an inner cavity 56 corresponding generally in configuration to the combined outer surface of constricted portion 50 and bulb 52. The pipette tip also includes a solid cylindrical forwardmost plug segment 58 and a rearwardmost cylindrical flange 60 having a central hole 62 which opens into cavity 56 and which is defined by an inwardly tapered cross-sectionally circular side wall 64. For reasons to be discussed below, the plug segment 58 of pipette tip 46 and its flange 60 are movable between relaxed, expanded configurations as shown in FIG. 4 and forced, contracted configurations. In a preferred embodiment, the entire tip is an integrally formed unit constructed of a resiliently deformable, elastomeric material such as a suitable rubber or plastic material, for example, a polyethylene material meeting these requirements. In this, plug segment 58 and flange 60 can be made movable between their expanded and contracted configurations. At the same time, cavity 56 serves to receive front end segment 48 of the stem in a tightly fitted fashion.

As will be discussed below, when the pipette 46 tip is placed on stem segment 48 and located within barrel chamber 22, it is caused to move with stem segment 48 through barrel chamber 22 in a predetermined way to first collect and thereafter dispense a predetermined quantity of a given specimen. As will also be seen, when the tip is in the barrel chamber it is maintained in its contracted configuration by the inner wall of the barrel itself, thereby providing a relatively tight fit between the two. This feature permits positive displacement pipetting and wipes the inner sidewall of the barrel clean of residue when the sample is dispensed. On the other hand, when the pipette tip is allowed to relax outside the barrel chamber, the plug portion 58 and flange 60 are larger in diameter than the chamber. This is specifically intended in order to provide a rapid automatic way of separating the tip from the stem, as will be discussed.

Figure 5:
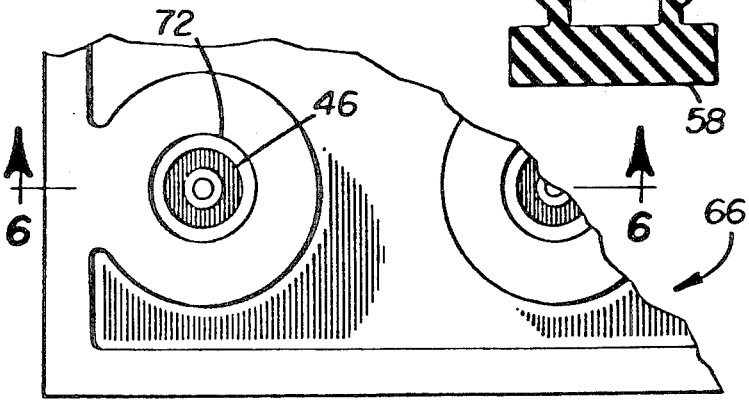
FIG. 5 is a top plan view of a pipette tip containing plate arrangement for aiding in placing a tip of the type illustrated in FIG. 4 onto the stem end portion illustrated in FIG. 3 and in an operating position in the overall pipetting device shown in FIG. 1.
Figure 6:
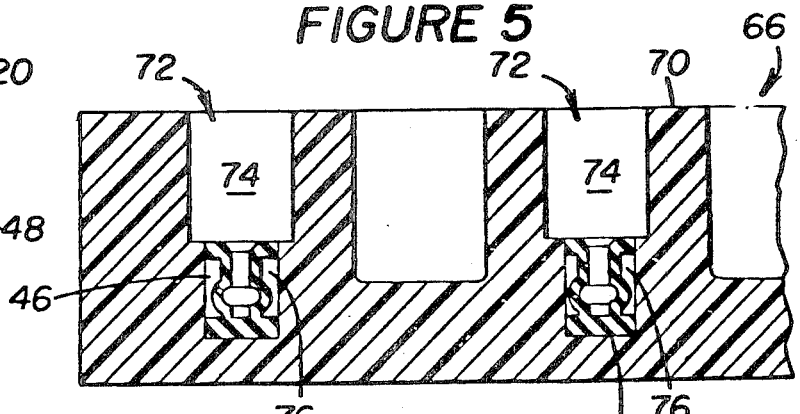
FIG. 6 is a sectional view of the arrangement shown in FIG. 5, taken generally along line 6-6 in FIG. 5.
Figure 8:
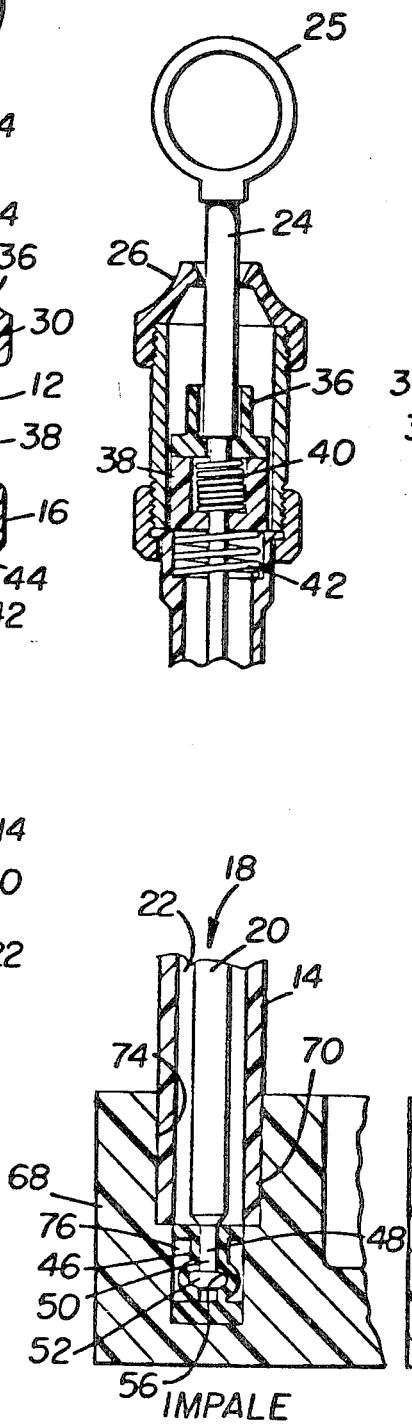
FIG. 8 is a view similar to FIG. 7 of the pipetting device but showing how a pipette tip is placed on its associated stem utilizing the arrangement shown in FIGS. 5 and 6.

Having described pipetting device 10, attention is now directed to its method of operation including the particular way in which a given tip 46 is placed on the front end segment 48 of stem 20 and into barrel chamber 22 as well as the particular way in which the tip is automatically removed from the stem. To this end, reference is made to FIGS. 5 and 6 which disclose a tip holding plate arrangement 66 which includes a flat plate 68 having a top side 70 containing a plurality of predesigned cavities 72 extending into the body. Each cavity includes an uppermost cavity section 74 and a cross-sectionally smaller bottom cavity section 76 located below and co-axial with the upper section. Section 74 has an inner diameter that is slightly larger than the outside diameter of the front end segment of barrel 14 so as to receive the latter therein in a closely fitting fashion. Bottom section 76 is axially the same length as pipette tip 46 and has a cross-sectional configuration corresponding to but slightly smaller than the cross-sectional configurations of plug portion 58 and flange 60. More specifically, cavity section 76 has an inside diameter that corresponds in size to the inside diameter of the barrel chamber 22 and thus is sufficiently small to receive and maintain a pipette tip in its contracted configuration as illustrated in FIGS. 6 and 8. With regard to this latter drawing figure, it should be noted that the cross-sectional configuration of cavity section 76 corresponds identically to the cross-sectional configuration of barrel chamber 22.

Figure 9:
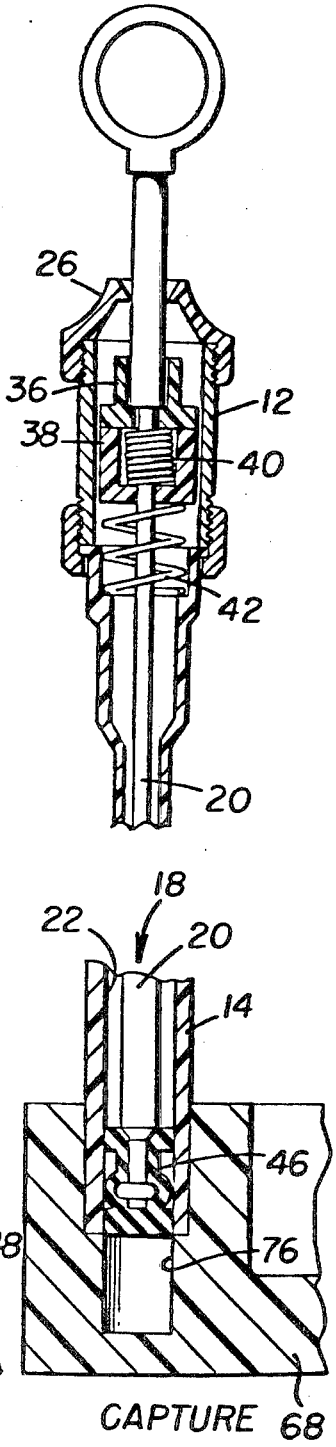
FIG. 9 is a view similar to FIG. 7 and 8 of a pipetting device but showing how the pipette tip placed on the stem is located within a barrel which also forms part of the pipetting device.

Referring to FIGS. 8 and 9, attention is now directed specifically to the way in which a pipette tip is placed in its operating position on stem 20 and in barrel chamber 22. To this end, overall stem 18 is sufficiently long relative to barrel 14 such that its front end segment 48 is movable to a position outside and forward of barrel chamber 22. With this in mind, a given pipette tip is placed in its operating position on stem segment 48 and within barrel 22 by first forcing the tip into an empty cavity section 76 of a tip holding plate 66 in the position shown in FIG. 8. This forces the tip into its contracted configuration corresponding cross-sectionally in size to barrel chamber 22. Thereafter, a front end section of barrel 14 is placed in the cavity section 74 directly above the contracted tip and the stem 18 is caused to move so that its front end segment 48 moves from a position within the barrel chamber (FIG. 7) to the external position just mentioned (FIG. 8). This, in turn, causes stem portion 50 and bulb 52 to enter opening 56 and interlock with the tip. Thereafter, stem segment 48 is drawn back into the barrel chamber (FIG. 9) and carries the contracted tip with it. The tip is now ready to function in its intended way for collecting and dispensing a given specimen.

Figure 10:
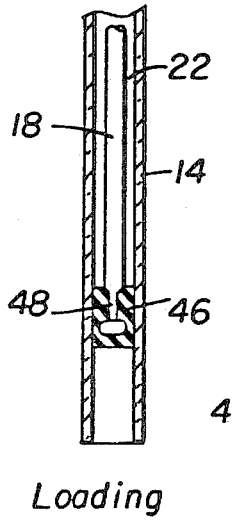
Figure 11:
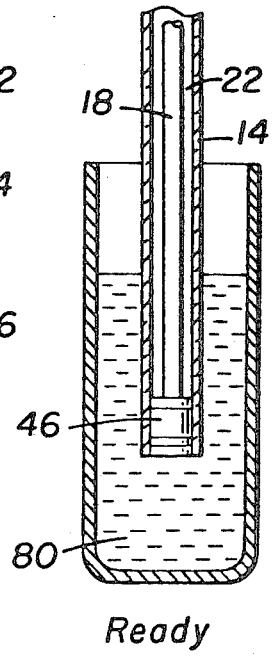
Figure 12:
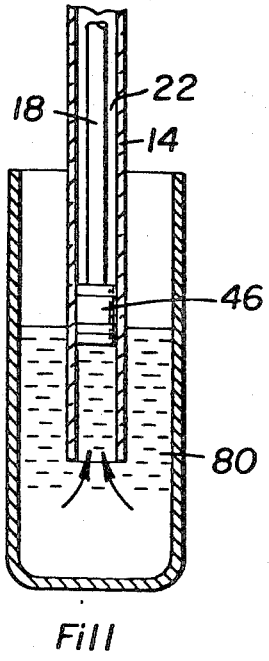
Figure 13A:
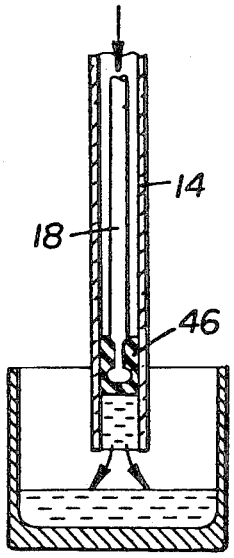
Figure 13B:
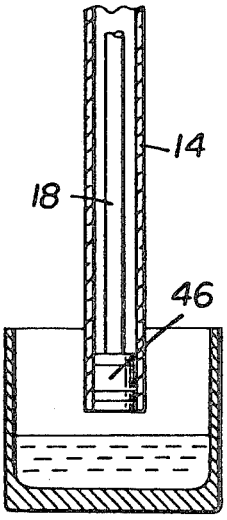

Referring now to FIGS. 10-13 attention is directed to the way in which pipetting device 10 functions to collect a given specimen within its barrel chamber and thereafter dispense it therefrom. In FIG. 10, barrel 14 is shown with stem 18 and a pipette tip 46 in its LOADED loaded position, that is, connected to the stem and disposed within the barrel chamber. In FIG. 11, the front end segment 48 of stem 20 and tip 46 have been moved to a READY position within barrel chamber 22 and at its forwardmost end. With the tip in this position, a front end section of the barrel is placed in the specimen to be collected generally indicated at 80 in FIG. 11. Thereafter, as seen in FIG. 12, tip 46 is moved upward to its FILLED position, thereby drawing a predetermined quantity of the specimen into the barrel chamber behind it. Going to FIGS. **13*a* and 13*b***, once the specimen is collected within the barrel chamber it can be dispensed therefrom by moving the tip to a DISCHARGE position which is identical to the READY position, that is, within the barrel chamber at the forwardmost end thereof.

With specific reference to FIGS. 7-9, it should be apparent that the previously described components within main body 12 cooperate with stem 18 so as to bias tip 46 in its LOADED or FILLED position and also tactically indicate to the operator the location of the READY/DISCHARGE position. As seen in FIG. 9, as the tip is forced from its bias LOADED position to its READY/DISCHARGE position, the upper spring 40 is completely compressed while the larger bottom spring remains unaffected. This is because spring 40 is more easily compressed than spring 42. In order to move the stem further downward, the lower spring must begin to compress, thereby indicating to the operator by means of feel when the tip is in its READY/DISCHARGE position.

Figure 14A:
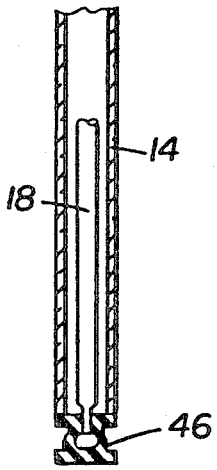
Figure 14B:
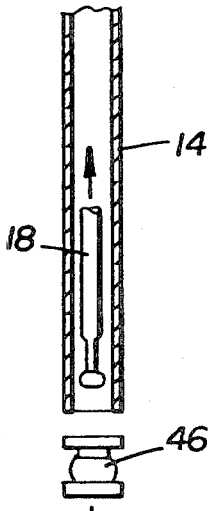

Referring now to FIGS. **14*a* and 14*b*, attention is directed to the way in which a given tip is automatically removed from its associated stem after use. This is accomplished by first moving the front end segment 48 of stem 18 and the tip connected thereto from its DISCHARGE position within the barrel chamber to its forwardmost EJECT position beyond the end of the barrel chamber, as illustrated in FIG. 14*a*. This causes the tip to wipe the inside surface of the barrel of any sample residue, thereby reducing the possibility of cross-contamination. Movement of the tip to its EJECT position automatically causes it to relax and thereby move from its contracted configuration to its expanded configuration which, as stated previously, means that it becomes larger cross-sectionally than the barrel chamber. Thereafter, stem segment 48 is caused to be drawn back into the barrel chamber as illustrated in FIG. 14***b*. Since the tip is in its larger relaxed configuration, it does not fit back into the barrel chamber and is thereby automatically separated from the stem as shown.

At this point it is worth noting that main body 12 (see FIG. 1) may be made available in different lengths, as indicated above. This allows the stroke of the stem to be varied, thereby allowing different amounts of sample to be drawn up into barrel 14. In order to replace one main body with another, the coupling means 16 and end cap 26 are thread connected with an associated main body. Moreover, the end cup can be turned relative to its main body to precisely adjust (fine tune) the amount of sample to be obtained.

Having described pipetting device 10 and the way in which it functions, attention is now directed to an arrangement shown in FIGS. 15–18 which may be advantageously used therewith. This arrangement is generally indicated by the reference numeral 82 in FIG. 15 and is shown there including an overall housing 84. As illustrated best in FIG. 18, housing 84 defines three separate inner compartments, a central compartment 86 and two side compartments 88 and 90 which are separated from one another by spaced upstanding walls 92 and 94. As will be discussed below, the central chamber serves to collect used pipette tips and, at the same time, it includes an assembly of components for automatically wiping specimen residue from the outer surface of the front end section of barrel 14.

Referring specifically to FIGS. 16 and 17, the assembly of components just mentioned includes an elongated strip of loosely woven cotton material 96, most of which is initially stored within its own container 98 within compartment 86 in the folded fashion shown in FIG. 17. An end section of this material is passed through a cooperating opening in container 98 and extends along a horizontal path directly under an opening 100 into the central chamber from the top side of housing 84. The material thereafter passes between a drive roller 102 and a press roll 104 which, with other components to be discussed, serves to move the sheet material in incremental steps from its supply container 98 along a horizontal path in the direction of arrow 106 and eventually to the bottom of chamber 86.

As stated previously, overall arrangement 82 serves to collect used pipette tips after they are used by pipetting device 10 and for wiping specimen residue from a front end section of barrel 14. More specifically, after the device has been used to collect and dispense a specimen in the manner described above and before its pipette tip is removed as also described above, the barrel 14 is inserted through opening 100 in arrangement 82 sufficiently to pass its specimen contaminated front end section through strip material 96 as best illustrated by dotted lines in FIG. 17. With the barrel in this position, its pipette tip is removed, thereby causing it to fall to the base of chamber 86. After this has been accomplished, the barrel is removed from chamber 86. As the front end section of the barrel contaminated with the collected specimen is inserted into and removed from the mesh material, the specimen residue is removed by the material. At the same time, as will be discussed hereinafter, cooperating control components in chambers 88 and 90 forming part of arrangement 82 respond to this procedure by automatically moving the strip material an increment in the direction of arrow 106 after the pipette barrel has been removed. This places a clean segment of the material directly under opening 100 for the next cycle.

Referring specifically to FIG. 18, attention is directed to these last mentioned control components which include an electrical stepping motor 108 powered by a suitable power cell 110 both of which are located in chamber 88. As seen there, the stepping motor includes a drive shaft 112 which is coupled to drive roller 102 in chamber 86 (see FIG. 16). The components also include a control circuit comprising a light source 114, a cooperating photocell 116 and suitable time delay electric circuitry generally indicated at 118. The light source and photo cell are respectively disposed within chambers 88 and 90 in a common horizontal plane and are in optical alignment through cooperating openings 120 and 122 in the side walls 92 and 94, respec- tively.

As best seen in FIG. 17, the light source and photocell are positioned such that the line of sight between the two is interrupted when barrel 14 is positioned within chamber 86 in the manner described previously. This is important to the operation of the control circuitry 118. More specifically, until a given pipette barrel is inserted into and removed from chamber 86, stepping motor remains de-energized and sheet material 96 does not move. As soon as a barrel is inserted into and removed from the chamber 86 in the manner described previously, this is sensed by the combination light source and photocell which, after being optically uncoupled from one another and thereafter coupled together again, initiate a timing circuit in circuitry 118 which causes the power cell 110 to energize the stepping motor a predetermined period of time thereafter sufficient to allow the barrel to be entirely removed from chamber 86. The motor is energized only sufficient to cause its shaft to be rotated an increment which, in turn, causes the sheet material to move an increment, as described previously. Thereafter, the circuitry 118 automatically resets itself in order to maintain the motor in a de-energized state until the pipette barrel is again inserted into and thereafter removed from chamber 86, at which time the process is repeated. Eventually, chamber 86 will fill up with used pipette tips or all of the strip material 96 will be used up. In order to remove these tips and/or replace the used strip material with new material, housing 84 includes suitable means for obtaining access to chamber 86 as well as the other chambers. As illustrated in FIG. 15, a door 124 serves this purpose.

Having described arrangement 82 and its operation, attention is now directed to an automated pipetting apparatus designed in accordance with the present invention. This apparatus which is generally indicated at 130 in FIG. 19 is best illustrated in this latter figure in conjunction with FIGS. 20–25. Referring first to FIGS. 19–21, the overall apparatus is shown including an outermost housing 132 including switches 134, 136 and 138 to be discussed hereinafter and a readout display 140 which will also be discussed hereinafter. As seen best in FIG. 20, the apparatus also includes an elongated open ended pipette barrel 142 partially depending from the bottom end of housing 132 in a vertically extending direction. A stem 144 which is only partially shown in FIGS. 19 and 20 also comprises part of the overall apparatus and is shown extending through barrel 142 so that a front end section 146 thereof is disposed outside and below the barrel's inner chamber 148. Front end section 146 may be identical to the front end section 48 of previously described stem 22 (see FIG. 3) or it may be more arrow shaped as illustrated in FIG. 20. A replaceable tip 148 corresponding in function to previously described tip 46 is disposed on stem section 146 and is best shown separate from the stem in FIG. 21.

Referring to this last-mentioned figure, it can be seen that tip 148 has an opening or cavity 150 which corresponds in configuration to stem section 146. It also includes a main body 152 having an outwardly flared back end 154 and a front plug segment in the form of a radially outward circumferential flange 155 corresponding in function to plug segment 58 of plug tip 46 (see FIG. 4). Like previously described pipette tip 46, tip 148 is designed to move between a relaxed expanded position larger cross-sectionally than barrel chamber 148 and a forced contracted position sufficiently small to fit tightly but slidably within barrel chamber 148. In a preferred embodiment, the tip is constructed as an integral unit from a resiliently deformable material, for example, rubber.

In addition to the components thus far described, FIG. 20 shows part of a pipette tip feed plate generally indicated at 156 and part of a tip supply magazine generally indicated at 158. As its name implies, magazine 158 serves to contain a supply of replaceable tips 148 and is designed to deliver these tips, one at a time, to the feed plate 156, as will be described in detail hereinafter. As will also be described hereinafter, the feed plate serves to place successive pipette tips in a LOADING position directly over and in alignment with the top open end of barrel 142. At the same time, an arrangement of components forming part of the overall apparatus to be described in conjunction with FIGS. 22–25 serve to automatically place the stem 144 in a sufficiently raised position such that stem section 146 is above feed plate 156, that is, in its LOADING position. Thereafter, the stem is caused to move downward and into the awaiting tip for connecting the latter thereto. The stem continues to move causing its front end section and the impaled tip to enter barrel chamber 148. As the tip enters the barrel chamber it is forced into its contracted configuration in a manner to be discussed hereinafter with regard to FIG. 25. In accordance with the automated process, stem section 146 and its tip move all the way down to the bottom end of the barrel and stop at what is referred to as the READY position. Thereafter, the front end section of the barrel is placed into a given specimen or a given specimen is brought into this position while the barrel remains stationary. In either case, the stem is then raised so as to move the tip upward to a predetermined FILLED position which depends upon the desired amount of specimen to be collected. Thereafter, the specimen collected is dispensed into a new container by moving tip 148 from its FILLED position to a DISPENSE or DISCHARGE position which is identical to its READY position at the bottom of barrel chamber 148. Finally, after the collected specimen has been dispensed, stem section 146 and the stem are moved to the previously mentioned EJECT position outside and below the barrel chamber, causing the tip to automatically move to its relaxed, expanded configuration. Thereafter, the stem section 146 is brought back into the barrel chamber, thereby causing the tip to be ejected therefrom since the tip no longer can fit back into the barrel. The previously described arrangement 82 could be utilized in conjunction with this latter step. These movements and positions are identical to the movements and positions described above in connection with FIGS. 10–14.

As stated previously, overall apparatus 130 includes a number of components in addition to those recited for carrying out the procedure just described in an automated manner. These additional components are best illustrated in FIGS. 22–24 and include an arrangement 160 for moving stem 144 between the four positions described, that is, between its LOADING, READY (DISPENSE), FILLED and EJECT positions, and for monitoring in exactly which of these positions the stem is in at any given time during the procedure. The additional components also include an arrangement 162 including the feed plate 156 and the magazine 158. Finally, these additional components include the previously mentioned switches 134, 136 and 138 and the display 140 as well as the control circuitry schematically illustrated in FIG. 26 at 164.

Referring specifically to FIGS. 22 and 23, attention is directed to arrangement 160. This arrangement includes a vertically extending threaded shaft 166 supported within housing 132 for rotation about its own axis by opposing upper and lower support plates 168 and 170. To this end, the support plates include cooperating bearings 172 and 174 for receiving upper and lower unthreaded end sections of the shaft indicated at 176 and 178, respectively, as illustrated in FIG. 23. A reversable motor 180 also forms part of arrangement 160 and is coupled to shaft 166 through a series of gears generally indicated at 182 so as to rotate the shaft about its own axis either clockwise or counterclockwise in a controlled manner to be described hereinafter. To this end, a suitable power supply such as the battery 184 shown within housing 132 forms part of circuitry 164 for energizing motor 180 in a controlled fashion.

In addition to the components thus far described, arrangement 160 includes a jack screw 186 threadably mounted around the shaft 166 so as to move down the shaft when the latter is rotated in one direction and up the shaft when it rotates in the opposite direction. As seen in both FIGS. 22 and 23, the jack screw is fixably connected to a top end section of pipette stem 144 so as to cause the stem to move up and down with it. More specifically, the jack screw is moved in a controlled manner between four distinct positions along shaft 166 in order to place the stem in its LOADING, FILLED, READY, (DISPENSE) or EJECT position. To this end, arrangement 160 includes four HALL effect sensors S1, S2, S3 and S4 in predetermined locations along the length of and adjacent to shaft 166. At the same time, jack screw 186 is constructed of a magnetic material or, as illustrated in FIG. 23, carries with it a magnetic member 188. The four sensors and this sensing member along with cooperating circuitry forming part of the circuit arrangement 164 indicate if and when member 188 is directly adjacent any one of these sensors by producing a corresponding electrical signal. The sensor S1 is fixedly mounted within housing 132 by any suitable means at a location corresponding to the LOADING position of stem 144. The S2 sensor is suitably fixedly mounted within the housing at a location corresponding to the READY (DISPENSE) position of the stem and the sensor S4 is fixedly located in a suitable manner within the housing so as to correspond to the EJECT position of the stem. Finally, the S3 sensor is located within the housing so as to correspond to the FILLED position of the stem but is preferably supported for limited vertical movement between various adjustable positions so as to be able to adjust the FILLED position and thereby adjust the amount of specimen to be collected. To this end, sensor S3 is preferably mounted on its own jack screw (not shown) which, in turn, would be mounted on its own threaded shaft (not shown) similar to shaft 166 and rotatable manually on and between, for example, the support plates 168 and 170 for adjusting the FILLED position.

From the foregoing, it should be apparent that circuit arrangement 164 in cooperation with the sensors S1, S2, S3 and S4 can be utilized to automatically move the stem 144 between its LOADING, READY (DISPENSE), FILLED AND EJECT positions automatically. At the same time, as will be seen hereinafter, the control signals from the sensors can be used to coordinate arrangement 160 with arrangement 162 to be described below.

Referring now to FIG. 24 specifically in conjunction with FIGS. 22 and 23, attention is directed to arrangement 162. As stated previously, this arrangement includes feed plate 156 and tip magazine 158. The feed plate is best illustrated in FIGS. 22 and 24 and is shown somewhat disc shaped so as to include horizontally extending top and bottom sides 190 and 192 (FIG. 23), respectively, and a vertically extending circular side wall 194. Side wall 194 includes equally circumferentially spaced semi-circular slots 196 and a plurality of equally circumferentially spaced through holes 198 extending through the plate from its top side to its bottom side for reasons which will be described hereinafter. The entire plate is located within housing 132 under shaft 166 and support plate 170 and includes a centrally located, downwardly depending support stem 200 extending into a cooperating bearing 202 located in a support frame 204. The support frame and the bearing support the stem 200 and therefore the entire feed plate for rotation about its central axis, again for reasons to be described hereinafter.

Referring now to the tip magazine 158, the latter is shown including an elongated main body 206 having a plurality of elongated chambers 208 (see FIG. 24) located outwardly of and equally circumferentially spaced around a central passageway 210. The outer chambers are open ended and, as will be seen hereinafter, serve to receive and store pipette tips 148. The tips are urged downward toward the feed plate 156 (see FIG. 22) by a spring, not shown, located in each elongated chamber 208. The central passageway 210 is closed at its bottom end (see FIG. 23) and is opened at its top end for the reasons to follow. The top end of main body 206 is adapted to receive an end cap 212 which closes the top ends of chambers 208 and which includes a central opening in alignment with passageway 210.

The bottom end of the magazine body 206 is located partially over a segment of feed plate 156 as best seen in FIG. 24 and partially over a bottom cover plate 212 forming part of the housing. The magazine is supported for axial rotation in this position at its top end by a support pin 214 having a bottom end section disposed within passage 210 and a top end section rotatably mounted within a bearing 216 in support plate 168. The pin 214 carries a fixed top flange 218 and a slidable bottom washer 220 with a compression spring 222 therebetween. The bottom washer engages against top cap 212 and the spring urges the bottom washer and the entire magazine downwards. At the same time, the bottom end of the magazine body includes a downwardly facing opening 224 which is semi-circular in cross-section for receiving a similarly configured drive thumb 226 which is best illustrated in FIG. 22.

Drive thumb 226 is fixedly connected for rotation with a horizontal gear 228 which comprises part of an overall gear arrangement generally indicated at 230. This gear arrangement also includes a worm gear within worm gear housing 232 and a gear 234 connected to the output shaft of a drive motor 236. The drive motor serves to rotate drive thumb 226 through the gear arrangement 230 for rotating magazine 158 in a controlled manner in cooperation with arrangement 160, as will be described in more detail hereinafter. At the same time, gear arrangement 230 includes suitable gears (not shown) for coupling motor 236 with feed plate 156 for rotating the latter in synchronism with magazine 158. To this end, arrangement 162, like arrangement 160, utilizes the various circuitry forming part of circuit arrangement 164. This circuitry includes a limit switch 240 (FIG. 24) having an actuation arm 242 which carries a roller 244 designed to engage within the slots 196 around the feed plate 156. The limit switch is designed so that its roller 244 continuously engages against the outer periphery of feed plate and therefore within the slots 196, one at a time. When the roller engages within one of these slots the switch is in one position and when the roller is forced out of a slot by movement of the feed plate (in the manner described hereinafter) the switch is in a second position. The function of this switch as it relates to the operation of overall arrangement 162 will be described hereinafter.

Having described the various mechanical aspects of arrangement 162, attention is now directed to the way in which it functions in cooperation with previously described arrangement 160. As stated previously, the six chambers 208 in magazine 158 serve to contain a supply of pipette tips 148. During operation the pin 214 and the spring 222 assembly permits an empty tip magazine to be removed from the pipettor and be replaced by a full magazine. In an actual embodiment, each of the chambers is sufficiently large in cross-sectional configuration to support a stack of tips in a loose fitting fashion such that the tips are urged toward the bottom of the chamber by a compression spring located in each chamber. In an alternative embodiment, the springs are not used and the tips are fed from the magazine by gravity. In either case, all of the chambers except one, specifically chambers A through E (see FIG. 24) are closed at their bottom ends by plate 212 (see FIG. 23). Thus, the pipette tips in these chambers do not move. At the same time, one of the chambers, specifically the F chamber, is always in registry with one of the holes 198 in feed plate 156. As a result, the lowermost tip in that chamber is forced into the registered opening.

The cross-sectional configuration of holes 198 will depend upon whether or not a gravitational feed or spring force is utilized in placing the tips therein. If a gravitational feed approach is used, the holes 198 must be made sufficiently large to receive by means of gravity at least a sufficiently long segment of each tip such that the top end of the latter clears the bottom of magazine 158. Whether a tip is registered in hole opening 198 by means of gravity or force, the opening must be configured so as not to allow the tip to pass entirely therethrough upon receipt. One way to accomplish this is to inwardly taper each of the holes from its top end to its bottom end. Another way is to provide the pipette tip with an outwardly and rearwardly flaring back end or wing as in tip 148. In this way, the back end prevents the tip from freely passing through opening 198, that is, without an intention to do so, as seen best in FIG. 25.

Having described how a given pipette tip is fed into a particular opening 198 in feed plate 156 from its magazine chamber in registry with that opening, attention is now directed to the way in which a particular pipette tip is placed in barrel 148 from an opening 198 in registry therewith. To this end, reference is made to FIG. 25 which shows this latter opening, a pipette tip disposed therein and the top end of barrel 142. In an actual working embodiment of the present invention, barrel chamber 148 is uniformly configured along its entire length, except for a top end segment 148'. This top end segment is larger at its uppermost end and tapers inwardly to merge with the rest of the chamber as illustrated in FIG. 25. The uppermost end of chamber section 148' is slightly larger than the forwardmost end of tip 148 and thereby is adapted to readily receive the latter as the tip is forced into chamber 148. More specifically, with a given tip within its associated opening 198 directly over barrel 142 in the manner illustrated in FIG. 25, stem 144 is caused to move from its position illustrated in FIG. 25 downward so as to impale the tip and force the latter into barrel 148. As the tip moves through barrel section 148' it is forced into its contracted configuration by the constricting cross-sectional areas leading to the uniform barrel section.

In certain cases, it may not be necessary to taper barrel chamber 148. For example, if tip 148 is sufficiently resilient so as to elongate when it is first impaled by stem 144, its cross-sectional dimensions may be sufficiently reduced to fit within the uniform cross-section of barrel 148. After the initial impaling force has been removed, the tip will attempt to return to its natural (non-elongated) state but will be prevented from doing so by the chamber wall. Another way to eliminate the taper in barrel chamber 48 is to provide an inwardly tapering front end segment on the pipette tip itself sufficient to fit within a uniformly configured barrel chamber. However, this means that the tapered front end section would not fit tightly within the chamber and is therefore not a preferred approach.

Having described how one pipette tip is placed in the feed plate from the magazine and how another pipette tip is placed into the barrel chamber from the feed plate, attention is now directed to the way in which the magazine and feed plate cooperate with one another. Specifically, let it be assumed that stem 144 has just ejected a tip and has moved back to its LOADING position corresponding to the S1 sensor. As soon as that happens, circuit arrangement 164 provides a signal which energizes motor 236 so as to cause both the feed plate 156 and magazine 158 to rotate clockwise as viewed in FIG. 24 until roller 244 engages the next slot 196. At that time, the motor is de-energized. At the same time, the feed plate and the magazine and the gears interconnecting them with motor 236 are designed such that the hole 198 that was in registry with barrel chamber 148 comes into registry with the next magazine chamber 208, specifically the A chamber and thereby receives a new pipette tip. At the same time, a hole 198 which already includes a pipette tip automatically comes into registry with barrel chamber. This procedure repeats itself each time stem 144 moves from its REJECT position to its LOADING position.

Having now described both arrangements 160 and 162, attention is now directed to the way in which the overall power driven apparatus 130 operates. First, let it be assumed that mode switch 138 is in the position illustrated in FIG. 19, that is, in its TWO SWITCH mode. Let it also be assumed that stem 144 is in its READY (S2) position within barrel 142 with a tip 148 connected thereto. With apparatus 130 in this operating condition, the front end segment of barrel 142 may now be placed in a supply of a given specimen to be collected. Thereafter, the switch 134 is depressed and held in this position which automatically causes the stem to move upward from its READY position to its FILLED position (S3). Thereafter, the barrel may be moved to a specimen receiving station. By releasing switch 134, the stem is automatically moved from its FILLED position to its DISPENSE position (S2). During this entire procedure, the feed plate and magazine do not move.

After carrying out the procedure just described and before collecting and dispensing another specimen sample, it is necessary to replace the tip used with a new tip. This is accomplished by depressing and releasing eject button 136. This automatically causes stem 144 to move from its DISPENSE positon to its EJECT position (S4) and thereafter to its LOADING position (S1) which causes the used tip to be ejected, in the manner described previously. After the stem has moved to its LOADING position, the feed plate and magazine are automatically caused to rotate one increment and thereafter stem 144 automatically moves back to its READY position, causing it to impale a new tip and move the latter into position within barrel 142 with it. Apparatus 130 is now ready to repeat its pipetting procedure.

Apparatus 130 may be operated in a SINGLE SWITCH mode by moving the switch 138 to the right as viewed in FIG. 19. In this mode, only switch 134 is used to operate the apparatus. Specifically, each time switch 134 is depressed and released, stem 144 is caused to move one step of its cycle, that is, from one of its operating positions to the following one in the normal operating procedure. Thus, assuming that the stem is in its READY position, depressing and releasing switch 134 causes the stem to move to its FILLED position. The next time the switch is depressed and released, the stem moves to its DISPENSE position. Thereafter it is caused to move to its EJECT position and then to its LOADING position and finally to its READY position, each of these steps requiring the operator to depress and release switch 134.

From the foregoing, it should be quite apparent that the automated operation described requires circuit arrangement 164 in conjunction with the various specific components described above. Circuit arrangement 164 includes the necessary circuitry to operate apparatus 130 in either its TWO SWITCH or SINGLE SWITCH mode. The actual circuitry illustrated in FIG. 26 corresponds to a specific working embodiment and is provided for exemplary purposes only. The circuitry per se could vary and, in any event, be readily provided in view of the teachings herein. Moreover, certain modifications to this circuitry could be provided depending upon the desired operation of the overall apparatus. For example, while the actual working embodiment of apparatus 130 referred to previously does not include the visual display 140 shown in FIG. 20, the apparatus could be readily modified to include one indicating the amount of specimen the apparatus has been set to pipette. This can be accomplished by sensing the position of sensor S3 relative to the other sensors and providing a calibration factor. A signal corresponding to this calibrated position could be readily provided by circuit arrangement 164 and used to drive the display 140 which could be, for example, a liquid crystal display. The visual display could also be used to indicate the precise position of the pipette tip 148 within barrel 142, as will be discussed in more detail below with regard to FIG. 27.

Referring to FIG. 27, jackscrew 186 is shown electromechanically connected to a lineal precision potentiometer 300 by means of a suitable wiper arm 302. The potentiometer is connected across a voltage, for example, the SVDC source illustrated. The voltage picked off of the pot is used to drive the visual display 140 which may be a conventional digital voltmeter having a liquid crystal display. Suitable, readily providable circuitry generally indicated at 304 may be provided for processing and calibrating the voltage from the pot so that the display indicates the position of the tip 148 by monitoring the position of the jackscrew. At the same time, the sensor S3 could be monitored for movement on a suitable support post 306 relative to the other sensors discussed above in order to establish the amount of specimen to be sampled. Sensor S3 includes its own wiper arm 308 which cooperates with pot 300 and circuitry 304 for visually indicating the selected specimen amount by the position of the sensor (actually its wiper arm) along the pot. A switch forming part of circuitry 304 could be provided for alternately selecting between the outposts from wipers 302 and 308 or two LCD arrangements could be used.

What is claimed is:

1. A pipetting device, comprising:

(a) an elongated barrel having forward and rearward open ends and an inner chamber extending therebetween; and (b) a plunger assembly including (i) a plunger stem having a front end section located within and movable along said inner barrel chamber, (ii) a separate plunger tip connected to the front end section of said stem so as to be readily removable therefrom and connectable thereto without damage to the stem, whereby a given tip can be readily replaced with another tip, and (iii) means for moving said stem and connected tip within said barrel in a controlled manner for collecting and dispensing a controlled amount of a given fluid (c) Said stem being sufficiently long relative to said barrel chamber such that said tip and the front end section of said stem are movable into a position outside said chamber beyond the forward end of said barrel, whereby said tip can be removed from said stem in said outside position; and (d) Said plunger tip including means movable between a compressed configuration when the entire tip is connected with said stem such that the entire tip can fit within said barrel chamber and a biased expanded configuration sufficiently large to prevent the tip from entering said barrel chamber, whereby movement of said tip from its stem connected position within said chamber to said outside position beyond the forward end of said barrel causes said tip means to automatically move from said contracted to expanded configuration for removal from said stem.

2. A device according to claim 1 wherein, with said stem connected tip located in said outside position with its tip means being in said expanded configuration, said tip is connected with the front end section of said stem in a way which makes it readily removable from said front end section by moving said front end section back into said barrel chamber.

3. A device according to claim 2 wherein said tip is constructed entirely of an elastic or elastomeric-like material which is resilient1y deformable between said compressed and expanded configurations.

4. A device according to claim 1 wherein said means for moving said stem and tip includes means for supporting said stem at a rearward end section thereof for movement along a line through its own axis and the axis of said barrel and motor means cooperating with said supporting means for moving said stem in said controlled manner for collecting and dispensing a controlled amount of said given fluid.

5. A device according to claim 4 wherein said supporting means includes a straight shaft means extending parallel with said stem and carriage means connected with said shaft means and movable along the latter in said controlled manner by said motor means, said carriage means being connected with said stem for moving the latter therewith.

6. A device according to claim 5 wherein said means for moving said stem and tip includes means for sensing when said carriage means is in predetermined positions along its line of movement and producing corresponding signals indicative thereof, said motor means being responsive to said signals for moving said stem in said controlled manner.

7. A device according to claim 6 wherein said predetermined positions for said stem along its line of movement include a first position in which said tip is within and at the forward end of said barrel for initially starting to collect said given fluid, a second position in which said tip is within said barrel above said first position by a predetermined amount depending upon the amount of specimen to be collected, and a third position in which said tip is in said position outside and beyond the forward end of said barrel whereby the tip can be removed from said stem.

8. A pipetting device, comprising:

(a) an elongated barrel having forward and rearward open ends and an inner chamber extending therebetween; and (b) a plunger assembly including (i) a plunger stem having a front end section located within and movable along said inner barrel chamber, (ii) a separate plunger tip connected to the front end section of said stem so as to be readily removable therefrom and connectable thereto without damage to the stem, whereby a given tip can be readily replaced with another tip, and (iii) means for moving said stem and connected tip within said barrel in a controlled manner for collecting and dispensing a controlled amount of a given fluid, said means for moving said stem and tip including means for supporting said stem at a rearward end section thereof for movement along a line through its own axis and the axis of said barrel and motor means cooperating with said supporting means for moving said stem in said controlled manner for collecting and dispensing a controlled amount of said given fluid, said supporting means including a straight shaft means extending parallel with said stem and carriage means connected with said shaft means and movable along the latter in said controlled manner by said motor means, said carriage means being connected with said stem for moving the latter therewith, said means for moving said stem and tip also including means for sensing when said carriage means is in predetermined positions along its line of movement and producing corresponding signals indicative thereof, and said motor means being responsive to said signals for moving said stem in said controlled manner said predetermined positions for said stem along its line of movement including a first position in which said tip is within and at the forward end of said barrel for initially starting to collect said given fluid, a second position in which said tip is within said barrel above said first position by a predetermined amount depending upon the amount of specimen to be collected, and a third position in which said tip is in said position outside and beyond the forward end of said barrel whereby the tip can be removed from said stem.

9. A method of collecting and dispensing a controlled amount of a given specimen, comprising the steps of:

(a) providing a pipetting device including
  (i) an elongated barrel having forward and rearward open ends and an inner chamber extending therebetween,
  (ii) a plunger stem having a front end section configured to move with and through said barrel,
  (iii) a separate plunger tip connected to the front end section of said stem so as to be readily removable therefrom and connectable thereto without damage to the stem, whereby a given tip can be readily replaced with another tip;
(b) moving the front end section of said stem and a connected tip through said barrel chamber in a predetermined way so as to first collect a controlled amount of a given specimen from a supply thereof and thereafter dispense said collected specimen at another location; and
(c) after collecting and dispensing said specimen and before collecting another specimen, replacing said tip with another, clean tip; and
(d) said step of moving said tip and the front end section of said stem in said predetermined way including moving these components between a first position in which said tip is within and at the forward end of said barrel for initially starting to collect said given specimen, a second position in which said tip is within said barrel above said first position by a predetermined amount depending on the quantity of specimen to be collected, a third position corresponding with said first position after all of the specimen collected has been dispensed, and a fourth position in which said tip is outside said barrel in front of its forward end so as to be readily removed from said stem.

10. A device according to claim 1 wherein said moving means includes a main tubular body connected with the rearward end of said barrel and through which said stem extends during its fluid collecting and dispensing movement, said moving means also including spring means within said body and acting on said stem to bias the stem in a given position.

11. A device according to claim 10 wherein said spring means includes two springs having different compression resistances and disposed within said tubular body relative to one another to allow a user to determine by feel a second given position of said stem.

12. A device according to claim 10 wherein said moving means alternatively includes a plurality of tubular bodies of different lengths and associated spring means, each body being disengagably connectable with the rearward end of said barrel and in cooperating with its spring means determining the amount of fluid to be collected and dispensed.

13. A device according to claim 10 wherein said stem includes a finger-hold attached to the back end of said stem.

14. A device according to claim 1 including means for indicating the position of said tip at any time during its movement with said stem.

15. A device according to claim 1 wherein said moving means includes means for changing the amount of fluid to be collected and dispensed, said device including means for indicating the particular amount selected by said amount changing means.

16. A pipetting apparatus for collecting and dispensing a controlled amount of a given fluid, said apparatus comprising:

(a) an elongated barrel having forward and rearward open ends and an inner chamber extending therebetween;
(b) a plunger stem having a front end section configured to move within and through said barrel;
(c) a separate plunger tip connected to the front end section of said stem so as to be readily removable therefrom and connectable thereto without damage to the stem, whereby a given tip can be readily replaced with another tip; and is in said third position and thereafter moved into said barrel chamber;
(d) means for moving said stem such that its front end section moves along a straight line path between
  (i) a first position in which said tip is within and at the forward end of said barrel for initially starting to collect said given specimen,
  (ii) a second position in which said tip is within said barrel above said first position by a predetermined amount depending on the quantity of specimen to be collected, and
  (iii) a third position in which said tip is outside said barrel in front of its forward end so as to be readily removed from said stem.

17. An apparatus according to claim 16 wherein said tip is connected to the front end section of said stem and configured relative to said barrel such that movement of the stem's front end section from said third position with said tip thereon to said first position causes said tip to separate from said stem without entering said barrel.

18. An apparatus according to claim 17 wherein said tip is at least in part constructed of a resilient material so as to be movable between a forced contracted configuration in order to fit within said barrel chamber and a relaxed expanded configuration larger than said chamber so as not to fit therein, whereby said tip is in its expanded configuration while in said third position so as not to fit within said chamber so that when said stem's front end is moved from said third to first position, the front end of said barrel thereby pushes to push said tip off of said stem.

19. An apparatus according to claim 18 including means for maintaining an unconnected tip in said third position in front of the forward end of said barrel but in a contracted configuration such that and until the contracted tip can be connected with the stem's front end section when the latter is in said third position and thereafter moved into said barrel chamber.

20. An apparatus according to claim 19 wherein said means for maintaining an unconnected tip includes means defining an elongated cavity having an inner axial segment sufficiently small in cross-sectional configuration to maintain a tip in said forced contracted configuration and a directly adjacent outer axial segment sufficiently large to receive a front end section of said barrel in axial alignment with said inner cavity segment.

21. An apparatus according to claim 16 including an arrangement having means for collecting a used tip immediately after the latter has been separated from said stem and means for wiping any residue of said given specimen from the outer surface of a front end section of said barrel as said tip is separated from said stem and collected.

22. An apparatus according to claim 21 wherein said wiping means includes a continuous strip of wiping material designed to allow the front end section of said barrel to pierce therethrough while surrounding portions of the material wipe the outer surface thereof, means for supporting said strip material for movement into and through a cleaning area adapted to receive said barrel front end section, whereby successive clean sections of said strip material can be moved into said area, and means for moving said clean sections of wiping material into and through said cleaning area.

23. An apparatus according to claim 22 wherein said wiping means includes means for sensing when the front end section of a given barrel has been inserted through a section of said wiping material in said cleaning area and thereafter removed therefrom and for producing a signal indicative thereof, said means for moving said strip material including motor means for moving said strip material including motor means responsive to said signal for moving the next successive section of said strip material into said cleaning area after a barrel has been removed from the wiping material.

24. An apparatus according to claim 22 wherein said tip collecting means includes a housing defining an inner compartment for receiving used tips and for containing said wiping means, said housing including a top side having an opening therethrough above and in vertical alignment with said cleaning area.

25. An apparatus according to claim 16 wherein said means for moving said stem moves the latter such that its front end section moves between said three positions and a fourth position outside and in back of the rearward end of said barrel for inserting a new tip thereon.

26. An apparatus according to claim 25 wherein said means for moving said stem and tip includes means for supporting said stem at a rearward end section thereof for movement in a way which moves its front end section between said four positions, and motor means cooperating with said supporting means for moving said stem so as to cause its front end section to move between said positions.

27. An apparatus according to claim 26 including means for connecting a tip on to the front end section of said stem when the latter is in said fourth position.

28. An apparatus according to claim 27 wherein said tip is connected to the front end section of said stem and configured relative to said barrel such that movement of the stem's front end section from said third position with said tip thereon to said first position causes said tip to separate from said stem without entering said barrel, said tip being at least in part constructed of a resilient material so as to be movable between a forced contracted configuration in order to fit within said barrel chamber and a relaxed expanded configuration larger than said chamber so as not to fit therein, whereby said tip is in its expanded configuration while in said third position so as not to fit within said chamber so that when said stem's front end is moved from said third to first position, the front end of said barrel thereby pushes said tip off of said stem.

29. An apparatus according to claim 28 wherein said tip connecting means includes means for maintaining an unconnected tip in a contracted configuration in a connecting position between said fourth position and the rearward end of said barrel such that the contracted tip can be connected with the stem's front end section as to the latter is moved from said fourth position into said barrel.

30. An apparatus according to claim 29 wherein said stem supporting means includes a straight shaft means extending parallel with said stem and carriage means connected with said shaft means and movable along the latter in said controlled manner by said motor means, said carriage means being connected with said stem for moving the latter therewith between any one of said four positions, said stem moving means also including means for sensing when said carriage means is in any one of said four positions and for producing a corresponding signal indicative thereof, said motor means being responsive to said signals for moving said stem in said controlled manner.

31. An apparatus according to claim 30 including means for monitoring the position of said carriage means on said shaft means and means responsive to the position of said carriage means for visually indicating the position of the tip on said stem.

32. An apparatus according to claim 31 wherein said position monitoring means includes a potentiometer connected with said carriage means by a wiper arm for producing a voltage dependent on the position of said carriage means and wherein said visual indicating means includes circuit means and visual display mean responsive to said voltage for indicating the position of the tip.

33. A removable tip for use with a pipetting apparatus of the type including an elongated barrel having an inner chamber, a plunger stem having a front end section movable within and along said barrel chamber, and means cooperating with said stem for moving its front end section through said barrel chamber in a controlled fashion, said tip comprising:

(a) a main body including means for disengagably connecting it to the front end section of said stem, said main body being sufficiently resiliently deformable to be means movable between a biased expanded configuration and a smaller, squeezed contracted configuration; and (b) said main body being sufficiently small when in its contracted configuration to fit tightly but slidably within said inner chamber of the barrel for drawing a specimen into and dispensing it from said chamber and sufficiently large when in its expanded configuration so as not to fit within said chamber of the barrel.

34. A removable tip according to claim 33 wherein said main body has a closed front end and a back end opening into a cavity within said main body for receiving the front end section of said stem and wherein said movable means includes a resilient flange located at and defining the front end of said main body.

35. A removable tip according to claim 34 wherein said main body including said flange is an integrally formed unit constructed of a resilient material.

36. An arrangement for use in a pipetting apparatus which utilizes a stem having a removable tip movable through a cooperating barrel for collecting and dispensing a controlled amount of a given specimen, said arrangement comprising:

(a) housing means having an inner chamber and an opening into said chamber for receiving a front end portion of said stem including said tip and a front end section of said barrel, whereby said tip can be removed within said chamber and collected therein; and (b) means for wiping any residue of said given specimen from the outer surface of a front end section of said barrel as said tip is separated from said stem and collected.

37. An apparatus according to claim 36 wherein said wiping means includes a continuous strip of wiping material designed to allow the front end section of said barrel to pierce therethrough while surrounding portions of the material wipe the outer surface thereof, means for supporting said strip material for movement into and through a cleaning area adapted to receive said barrel front end section, whereby successive clean sections of said strip material can be moved into said area, and means for moving said clean sections of the wiping material into said cleaning area.

38. An arrangement according to claim 37 wherein said wiping means includes means for sensing when the front end section of a given barrel has been inserted through a section of said wiping material in said cleaning area and thereafter removed therefrom and for producing a signal indicative thereof, said means for moving said strip material including motor means for moving said strip material including motor means responsive to said signal for moving the next successive section of said strip material into said cleaning area.

39. A method of collecting and dispensing a controlled amount of a given specimen, comprising the steps of:

(a) providing a pipetting device including (i) an elongated barrel having forward and rearward open ends and an inner chamber extending therebetween, (ii) a plunger stem having a front end section configured to move with and through said barrel, (iii) a separate plunger tip connected to the front end section of said stem so as to be readily removable therefrom and connectable thereto without damage to the stem, whereby a given tip can be readily replaced with another tip;

(b) moving the front end section of said stem and a connected tip through said barrel chamber in a predetermined way so as to first collect a controlled amount of a given specimen from a supply thereof and thereafter dispense said collected specimen at another location; and (c) after collecting and dispensing said specimen and before collecting another specimen, replacing said tip with another, clean tip said step of replacing the first-mentioned tip with another clean tip including the steps of locating the first-mentioned tip in a position outside and in front of said barrel chamber after it has been used for collecting and dispensing a given specimen, thereafter separating said first mentioned tip from said stem, and, once said first mentioned tip has been so removed, placing a clean tip onto the front end section of the stem left exposed by the removal of the first mentioned tip.

40. A method according to claim 39 wherein each of said tips is configured to move between a natural expanded configuration larger than said barrel chamber and a forced contracted configuration sufficiently small to fit within and slide long said chamber whereby said first-mentioned tip while in said chamber remains in its contracted configuration and when thereafter moved to a position outside and in front of said barrel automatically move to its expanded configuration, said step of separating said first-mentioned tip from said stem while in said last-mentioned position includes the step of moving the front end section of said stem from its position outside and in front of said barrel back into said barrel while said tip remains in its expanded configuration, whereby said expanded tip is caused to be pushed off of said stem.

41. A method according to claim 40 the step of placing said replaceable, clean tip onto said stem after the first-mentioned tip has been removed includes the steps of initially maintaining said replacement tip in its forced contracted configuration outside of said barrel chamber, while the replacement tip is maintained in this configuration, positioning the front end section of said stem in its position outside and in front of said barrel chamber, thereafter connecting the contracted reinforcement tip to the front end section of said stem, and while the connected reinforcement tip remains contracted, causing it and the front end section of said stem to move into said barrel chamber free of the means for maintaining it in its contracted configuration.

42. A method according to claim 39 wherein said step of moving said tip and the front end section of said stem in said predetermined way includes moving these components between a first position in which said tip is within and at the forward end of said barrel for initially starting to collect said given specimen, a second position in which said tip is within said barrel above said first position by a predetermined amount depending on the quantity of specimen to be collected, and a third position corresponding with said first position after all of the specimen collected has been dispensed.

43. A method according to claim 42 wherein said step of moving said tip and the front end section of said stem in a predetermined way further includes the step of moving said tip and the front end section of said stem between said first-mentioned positions and a fourth position in which said tip is outside said barrel in front of its forward end so as to be readily removed from said stem.

44. A method according to claim 9 including the step of moving the front end section of said stem between the last-mentioned positions and a further position rearwardly of and outside said barrel chamber without a tip connected thereto so that a clean replacement tip can be attached thereto.

45. A method according to claim 44 including the steps of removing the initially mentioned tip from said stem when the front end section of the latter and the first-mentioned tip are in said fourth position and replacing the first-mentioned tip with said replacement tip when the front end section of said stem is in the last-mentioned position rearwardly of and outside said barrel chamber.

46. A method according to claim 45 including the steps of sensing when said tip is in each of said positions and producing a corresponding signal, said signals serving to control the movement of said tip.

47. A method according to claim 46 including the steps of collecting said tips after they have been used and wiping any residue of said given specimen from the outer surface of a front end section of said barrel after all of the specimen collected has been dispensed.

48. A method according to claim 47 wherein said wiping step includes the steps of providing a continuous strip of wiping material designed to allow the front end section of said barrel to pierce therethrough while surrounding portions of the material wipe the outer surface thereof, supporting said strip material for movement into and through a cleaning area adapted to receive said barrel front end section, whereby successive clean sections of said strip material can be moved into said area, and moving a clean section of said wiping material into said cleaning area each time a barrel front end section is to be cleaned.

49. A device according to claim 48 wherein said sensing means includes means for adjusting said second position relative to said first position whereby to adjust the amount of said fluid to be collected.

50. A device according to claim 48 wherein said predetermined positions include a fourth position such that the tip carrying end of said stem is located outside and spaced from the rearward end of said barrel whereby a new tip can be placed on said stem end in said fourth position.

51. A pipetting device, comprising:

(a) an elongated barrel having forward and rearward open ends and an inner chamber extending therebetween;

(b) a plunger assembly including (i) a plunger stem having a front end section located within and movable along said inner barrel chamber, (ii) a separate plunger tip connected to the front end section of said stem so as to be readily removable therefrom and connectable thereto without damage to the stem, whereby a given tip can be readily replaced with another tip, and (iii) means for moving said stem and connected tip within said barrel in a controlled manner for collecting within said barrel and dispensing from said barrel a controlled amount of a given fluid, said moving means including means for moving said stem in a way which places said connected tip in a tip changing position outside said barrel for removal from said stem and replacement with another tip.

52. A device according to claim 51 wherein said tip changing position places said tip adjacent the forward open end of said barrel.

53. A device according to claim 52 wherein said barrel and said tip are configured such that upon positioning said connected tip in said tip changing position from a position within said barrel and then moving said stem rearwardly causes the tip to engage the forward end of said barrel and thereby separate from said stem.

54. A method of collecting and dispensing a controlled amount of a given specimen, comprising the steps of:

(a) providing a pipetting device including (i) an elongated barrel having forward and rearward open ends and an inner chamber extending therebetween, (ii) a plunger stem having a front end section configured to move with and through said barrel, (iii) a separate plunger tip connected to the front end section of said stem so as to be readily removable therefrom and connectable thereto without damage to the stem, whereby a given tip can be readily replaced with another tip;

(b) moving the front end section of said stem and a connected tip through said barrel chamber in a predetermined way so as to first collect a controlled amount of a given specimen whithin said barrel from a supply thereof and thereafter dispense said collected specimen from said barrel at another location; and (c) after collecting and dispensing said specimen and before collecting another specimen, moving said tip to a tip changing position outside said barrel and replacing said tip with another, clean tip at said tip changing position.

55. A method according to claim 54 wherein said tip changing position places said tip adjacent the forward open end of said barrel.

56. A method according to claim 55 wherein said barrel and said tip are configured such that upon positioning said connected tip in said tip changing position from a position within said barrel and then moving said stem rearwardly causes the tip to engage the forward end of said barrel and thereby separate from said stem.

* * * * *